US006239085B1

(12) United States Patent
Slack

(10) Patent No.: US 6,239,085 B1
(45) Date of Patent: May 29, 2001

(54) GREASE COMPOSITION CONTAINING PAO, ALKYLAROMATIC SYNTHETIC FLUID AND WHITE OIL FOR INDUSTRIAL BEARINGS

(75) Inventor: David Anthony Slack, Sarnia (CA)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/178,180

(22) Filed: Oct. 23, 1998

(51) Int. Cl.[7] ..... C10M 129/26
(52) U.S. Cl. ..... 508/539; 508/552
(58) Field of Search ..... 508/539, 552

(56) References Cited

U.S. PATENT DOCUMENTS

| | | | | |
|---|---|---|---|---|
| 3,159,575 | | 12/1964 | Criddle | 252/18 |
| 3,159,576 | | 12/1964 | Criddle | 252/18 |
| 3,189,543 | | 6/1965 | Criddle | 252/18 |
| 3,392,119 | * | 7/1968 | Mitacek | 508/591 |
| 3,428,562 | | 2/1969 | Crouch et al | 252/42 |
| 3,681,242 | | 8/1972 | Gilani et al. | 252/41 |
| 3,791,973 | | 2/1974 | Gilani et al. | 252/41 |
| 4,597,881 | | 7/1986 | Iseya et al. | 252/41 |
| 4,749,502 | | 6/1988 | Alexander et al. | 252/35 |
| 5,043,085 | | 8/1991 | Kinoshita et al. | 252/49.9 |
| 5,102,567 | * | 4/1992 | Wolf | 508/591 |
| 5,133,888 | | 7/1992 | Waynick | 252/33.4 |
| 5,364,544 | | 11/1994 | Otake et al. | 252/28 |
| 5,602,086 | | 2/1997 | Le et al. | 508/591 |
| 5,783,531 | | 7/1998 | Andrew et al. | 508/510 |

FOREIGN PATENT DOCUMENTS

| | | | |
|---|---|---|---|
| 2572089 | 10/1987 | (FR) | C10M/169/00 |

OTHER PUBLICATIONS

Roberts, J. P, High Dropping Pt Grease Thickeners in Synthetic Fluids, NLGI Spokeman, 46(5), 152–62, 1982.*
Loderer, D. Performance of USDA H 1 Authorized Fully Synthetic Greases. NLGI 61(6), 18–23, 1997.*

* cited by examiner

*Primary Examiner*—Margaret Medley
*Assistant Examiner*—Cephia D. Toomer
(74) *Attorney, Agent, or Firm*—Joseph J. Allocca; Norby L. Foss

(57) ABSTRACT

A grease of enhanced thermal stability and improved soap utilization comprises a major amount of a base oil comprising polyalphaolefin, alkyl aromatic synthetic fluid and white oil and a minor amount of soap thickener.

15 Claims, No Drawings

GREASE COMPOSITION CONTAINING PAO, ALKYLAROMATIC SYNTHETIC FLUID AND WHITE OIL FOR INDUSTRIAL BEARINGS

BACKGROUND OF THE INVENTION

1. Field of the Invention

The present invention relates to simple and complex metal soap thickened poly alpha olefin base greases containing additional lubricating oil constitutents said greases exhibiting enhanced thermal stability and improved thickener utilization resulting in improved grease yields.

2. Description of the Related Art

The grease lubrication of paper machine bearings is a considerable challenge due to the wide range of conditions that exist throughout the machine. In the wet end of the paper machine (i.e., forming and press sections), ambient temperatures are generally moderate (30 to 40° C.), with the grease being subjected to severe water washing. In the dryer-section, ambient temperatures may range from 90° C. to as high as about 140° C., with exposure to water vapor being a significant problem. Wet end wire-roll and press-roll bearings may be very large (usually double spherical roller type with 400 to 500 mm bore diameter). In the dryer sections, bearings are generally smaller (80 to 150 mm bore diameter), but operate at higher speeds.

Historically, paper machine OEM's have recommended different greases for these different parts of the machine. In the wet end, the greases recommended are generally of a softer consistency (NLGI #1), and require extreme pressure additives to provide bearing protection where boundary conditions may develop at relatively low operating temperatures. In the dryer-section, NLGI #2 greases with higher base fluid viscosities are suggested, and the use highly active extreme pressure agents is discouraged. Greases are offered in the marketplace for use throughout paper machines operating under severe conditions; these generally incorporate a 100% synthetic hydrocarbon base oil, which can create problems with respect to controlling the amount of soap present in the grease.

The production of simple soap and complex soap/salt thickened greases and techniques for improving grease yields have, however, long been practiced.

U.S. Pat. No. 3,159,575 teaches a process for improving grease yields of calcium soap/salt thickened greases by adding alkyl methacrylate-vinyl pyrolidone copolymers to the grease. The base oil vehicle for such greases is described as mineral oil exemplified by naphthenic oil, paraffinic oil and mixed base oils derived from petroleum, including lubricating oils derived from coal products, etc.

U.S. Pat. No. 3,159,576 also teaches a method for improving grease yield of calcium soap/salt thickened greases by adding quaternary ammonium compounds to the grease in combination with the calcium soap/salt thickener.

U.S. Pat. No. 3,189,543 similarly teaches a method for improving grease yield of calcium soap/salt thickened greases by incorporating an oil soluble poly glycol substituted polymer into the grease.

In the preceding patents the greases were made by producing the calcium soap/salt thickener in a first portion of the final grease mineral base oil, adding the specified yield improving polymeric or quaternary ammonium compound additive then adding the balance of the mineral base oil to make the total of 100% of the specified mineral oil.

U.S. Pat. No. 3,681,242 teaches a two stage process for the production of high dropping point lithium soap/salt thickened grease. In the process the complex lithium soap/salt thickener is prepared in a first portion of base oil. This first portion of base oil corresponds to between 30% to 75% of the total amount of oil which will be present in the final grease. The fatty acids and dicarboxylic acids are heated with stirring in this first base oil portion to about 180–210° F. Concentrated aqueous solution of lithium hydroxide is then slowly added and heated to 290–3 10° F. to insure elimination of water. The temperature is then further raised to at least 410° F. but no higher than 430° F. The balance of the base oil used to make the grease is then added to this mixture and the temperature is rapidly reduced to about 220° F. after which the mixture is reheated to about 350–375° F. followed by immediate rapid cooling to a temperature in the range 220–240° F. The mixture is held at this temperature for 8 to 16 hours then passed through a mill and cooled to room temperature.

Again, the oils used as the first and second (or balance) positions of oil employed are the same in each case.

U.S. Pat. No. 3,428,562 teaches a process for preparing a lithium grease composition containing synthetic oil as the sole lubricating oil component. The synthetic oils of interest is ester type synthetic lubricating oils. In this procedure fatty acid is saponified with aqueous lithium hydroxide at a temperature of 160–200° F. after which 23–41 wt % of the synthetic ester type lube oil based on the total weight of oil in the finished grease is added. This is followed by heating at a rate of at least 0.7° F. per minute to a top temperature of between 380 to 450° F. while adding or adding 30 to 56 wt % of the same or different synthetic ester type lube oil. The mixture is held at the aforesaid temperature for from 0 to 30 minutes followed by cooling and the addition of any balance of synthetic ester oil needed to make 100% of the final desired oil content.

U.S. Pat. No. 4,749,502 is directed to a grease composition comprising an oil component having a major amount of a synthetic fluid having a viscosity of at least 50 cSt at 40° C. and a minor amount of a mineral oil having a pour point below −20° C. and a thickener. The synthetic fluid is preferably polyalphaolefin. The thickener comprises the simple lithium, calcium, aluminum and/or barium soaps of fatty acids such as stearic acid or 12-hydroxy stearic acid, or the complex calcium, lithium, barium and/or aluminum soaps/salts of the aforesaid fatty acids with lower molecular weight mono- or dibasic acids.

In U.S. Pat. No. 4,749,502 the viscosity of the mineral oil is lower than the viscosity of the synthetic fluid over the temperature range for which the use is contemplated. In producing the grease a blend of the aforesaid oils was used as the base stock.

U.S. Pat. No. 4,597,881 teaches a process for producing a lithium soap grease comprising the steps of adding a hydroxy fatty acid and dicarboxylic acid to a first base oil having an aniline point of 110° C. to 130° C. at a temperature of less than 100° C. with stirring to prepare a uniform dispersion of acids in the first base oil. Thereafter lithium hydroxide is added to the mixture and the mass is heated to a temperature of 195° C. to 210° C. The mass is cooled to a temperature not higher than about 160° C. at a rate of 20° C. to 80° C. per hour. Finally, a second base oil having an aniline point of from 130° C. to 140° C. is added to the mass so that the weight ratio of the first base oil to the second base oil is from 30:70 to 60:40 and the resulting mixture has a dynamic viscosity of 5 to 50 cSt at 100° C. and an aniline point of from 125° C. to 135° C. The first and second base oils may each have a viscosity in the range 5 to 50 cSt at 100° C. In Examples 3 to 5 the first base oils employed had dynamic viscosities at 100° C. of 11.2 cSt, 11.4 cSt and 11.6 cSt while the corresponding second base oils employed had dynamic viscosities at 100° C. of 19.4 cSt, 19.2 cSt, and 19.2 cSt producing a final grease base oil blend having dynamic viscosities at 100° C. of 14.7 cSt, 14.7 cSt, and 14.8 cSt, respectively. In the case of these base oils, the components blended to make the base oils were 500 neutral oil, bright stock and naphthene mineral oil, no synthetic oils were used.

U.S. Pat. No. 5,364,544 are directed to grease for slide contacts based on synthetic oil which is polyalphaolefin. The PAO base oil consists of a synthetic PAO having a low viscosity of from 8 to 30 cSt at 40° C. and a synthetic PAO having a high viscosity of from more than 30 to about 470 cSt at 40° C. The base oil is apparently employed as a blend of such PAO's of different viscosities.

U.S. Pat. No. 5,133,888 teaches an engine bearing grease comprising a lithium soap thickener, a synthetic base oil blend of polyalphaolefins and extreme pressure anti wear additives and inhibitors comprising dithiocarbamates, phosphates, and hydroxides. In the examples the base oil used was a per se blend of two PAO.

FR 2,572,089 teaches a grease comprising 65 to 94.5 wt % lubricating oil, 25 to 5 wt % lithium soap comprising lithium salts of saturated $C_{14}$–$C_{24}$ dihydroxy monocarboxylic acids, and 10–0.5 wt % other additives. The lube oil base is described as preferably being a naphthenic or paraffinic mineral oil or a synthetic oil with a viscosity of 4–30 cSt at 100° C. The synthetic oil may comprise a polyalphaolefin containing a hydrogenated alkyl benzene to solubilize the soaps, or esters such as esters of $C_5$–$C_{10}$ fatty acids with polyols. An example describes a grease comprising 10 wt % hydrogenated alkyl aromatic, 55 wt % PAO, 15 wt % penta erythritol ester, 15 wt % lithium soap and the balance other additives.

SUMMARY OF THE INVENTION

A grease of enhanced thermal stability and improved soap utilization comprises a lubricating oil base comprising a mixture of polyalpha olefin, alkylated aromatic and white oil, and a soap thickener.

DESCRIPTION OF THE INVENTION

A lubricating grease is disclosed which comprises a base oil comprising a mixture of polyalphaolefin, alkyl aromatic and white oil, and a soap thickener. Such greases have been found to provide yield improvements superior to those made possible by use of polyalpha olefins and alkyl benzene alone. Grease made with white oil, polyalpha olefin and alkyl aromatic oil retain the excellent thermal stability of the synthetic greases while showing stability which is superior to that obtained with grease made from blends of polyalpha olefin with conventional naphthenic or paraffinic oils.

The greases of the present invention contain as base oil, one or more poly alpha olefin(s) in an amount of greater than about 40 wt %, preferably greater than about 50 wt % (of all the oil components present), one or more alkyl aromatic synthetic oil(s) in an amount of about 5 to 30 wt %, preferably about 10 to 20 wt % (of all the oil components present) and white oil in an amount of about 10 to 40 wt %, preferably about 20 to 30 wt % (of all the oil components present), and a simple or complex soap thickener.

PAOs have viscosities in the range of about 1 to 150 cSt at 100° C. Typical PAOs are PAO-2 (vis of about 2 $mm^2/s$@100° C.), PAO 4, (vis of 4 $mm^2/s$ at 100° C.), PAO 6 (vis of 6 $mm^2/s$ at 100° C.), PAO S (vis of about 8 $mm^2/s$ at 100° C.) PAO 40 (vis of about 40 $mm^2/s$ at 100° C.) and PAO 100 (vis of about 100 $mm^2/s$ at 100° C.).

Such polyalphaolefins may be produced from linear alpha olefins containing about 8–12 carbon atoms by an oligomerization process which produces dimers, trimers, tetramers, pentamers, etc., of these olefins. In general, the viscosity of the polyalphaolefins increases with the molecular weight of the oligomer, while the mono olefin carbon number, linearity, and position of unsaturation, determine the VI and pour point of the polyalphaolefin oligomer. Generally, the higher the carbon number of the mono olefin, the higher the VI and the higher the pour point of the oligomer. Nonlinear mono olefins are not prefeffed, since they tend to produce lower VI oligomers. Internal olefin monomers also produce more branched polyolefin structures which exhibit lower VI's and generally lower pour points. A satisfactory combination of pour point, viscosity and VI has been obtained by polymerizing $C_{10}$ linear alpha olefins monomers and hydrogenating the resulting polymer.

Alkyl aromatic synthetic base oils include (a) one or more mono-, or poly- substituted benzene or naphthalene, the mono- or poly- substitutents bring straight or branch chain $C_3$ to $C_{30}$ hydrocarbyl group as well as (b) diaryl alkanes and mixtures thereof.

Alkyl aromatics, therefore, can be represented by the formula:

$$(R)_n\text{—AR and } (R'')_z\text{AR—}(R')_x\text{—AR—}(R''')_y$$

wherein:

AR is phenyl or naphthyl;

R is $C_3$–$C_{30}$ hydrocarbyl preferably $C_{10}$–$C_{14}$;

n is in integer ranging from 1 up to the unsatisfied valance of AR, preferably 2;

R' is —$CH_2$—; R" and R'" are the same or different $C_3$ to $C_{30}$ hydrocarbyl, preferably $C_{10}$–$C_{14}$;

x ranges from 1 to 20, preferably 1 to 14, y and z are individually integers ranging from 0 to up to the unsatisfied valance of AR.

Preferred alkyl aromatics are disubstituted alkyl benzene where the alkyl groups are the same or different and contain between 10 and 14 carbons.

White oil is a naphthenic or paraffinic base oil containing <10%, preferably <5%, most preferably <1% aromatic carbon, and <5000 ppm, preferably <1000 ppm, most preferably <100 ppm sulfur and having a viscosity of from 5 to 100 cSt at 40° C., preferably about 50 to 100 cSt at 40° C. Oils meeting the requirements of FDA 21 CFR 178.3620 and 172.878 are examples of oils within the scope of the definition of white oils.

Thickeners useful in the present grease formulation include lithium, calcium, barium and/or aluminum soaps, urea, di-urea, tri-urea and polyurea, preferably simple lithium soaps, complex lithium, calcium, barium, and/or aluminum soaps/salts, preferably complex lithium soap and mixed lithium-calcium soaps.

In general, the grease formulation of the present invention contains anywhere from 1 to 30 wt % thickener, preferably 5 to 15 wt/o thickener, based on the finished formulation, but as previously indicated, the amount of thickener present in the PAO grease made according to the present invention will be lower than the amount present in a comparable PAO grease made using as base oil a combination other than polyalphaolefin and alkyl aromatic and white oil.

Polyurea thickeners are well known in the art. They are produced by reacting an amine or mixture of amine and polyamine or mixture of polyamines with one or more diisocyanates and/or one or more isocyanates as appropriate. The reaction can be conducted by combining and reacting the group of reactants, taken from the above list in a reaction vessel at a temperature between about 15° C. to 160° C. for from 0.5 to 5 hours. Detailed discussion of polyurea thickener production for greases can be found in U.S. Pat. No. 4,929,371.

Simple and complex lithium or calcium soaps for use as thickeners in grease formulations and their method of production are also well known to the grease practitioner. Simple soaps are produced by combining one or more fatty acid(s), hydroxy fatty acid(s), or esters thereof in a suitable solvent usually the grease base oil.

A preferred technique to be employed in practicing the production of this PAO based grease is an adaptation of the procedure disclosed and claimed in U.S. Pat. No. 5,783,531, which teaches a method for improving the yields of PAO base oil greases wherein the grease viscosity grade is determined by the viscosity of the final base oil in the grease, the method comprising forming a thickener in a quantity of a first PAO oil, said first PAO oil having a viscosity which is lower than the final base oil viscosity of the grease to form a first thickened mass, and adding to the first thickened mass a sufficient quantity of a second PAO oil which has a viscosity which is higher than that of the final base oil viscosity of the grease to thereby produce a finished grease product containing a final mixture of PAO oils having the desired viscosity of the final total base oil.

In the present invention the first lower viscosity oil fraction is a first oil fraction comprising the white oil and alkyl aromatic synthetic oil, or mixture of white oil, alkyl aromatic synthetic oil and PAO base oils, of viscosity lower than that of the total base oil to be used in the final grease formulation and reacting the acids or esters with the appropriate base, e.g., LiOH or $Ca(OH)_2$. When PAO is employed in this first oil fraction, and its use at this stage is optional, the amount used is typically an amount sufficient to achieve the desired thickener component concentration in the thickener formation step; where more than one PAO component is present in the finished grease base oil blend the PAO of lower viscosity will be preferably included in the first oil fraction of the thickener formation step. This lower viscosity PAO can be a lower viscosity PAO per se or it can be a blend of a higher and lower viscosity PAO, the ratio of lower to higher viscosity PAO being selected such that the viscosity of any such PAO mixture used in the thickener formation step will be lower than the viscosity of any PAO added later in the oiling up step following completion of the thickener formation step.

In the oiling up step the oil added is the PAO or any of the remaining PAO which was not used in the thickener formation step. This oiling up component can be the PAO per se or it can contain minor amounts of white oil and/or alkyl aromatic required to produce a finished grease product containing a final mixture of white oil, alkyl aromatic and PAO containing the desired ratio of base oil components and having the target viscosity of the final total base oil.

Complex lithium or calcium soap thickeners are prepared by combining one or more fatty acid(s), hydroxy fatty acid(s) or esters thereof with an appropriate complexing agent in a first lower viscosity oil fraction containing the white oil and alkyl aromatic synthetic oil, or mixture of white oil, alkyl aromatic synthetic oil and PAO and reacting the mixture with the appropriate base, e.g., LiOH or $Ca(OH)_2$. The complexing agent typically consists of one or more dicarboxylic acids, or esters thereof, or one or more $C_2$ to $C_6$ short chain carboxylic acids, or esters thereof.

The fatty acid or hydroxy fatty acid used in the production of the thickeners employed in the grease of the present invention has 12 to 24 carbon atoms. Thus lithium or calcium salts of $C_{12}$ to $C_{24}$ fatty acids or of 9-, 10- or 12-hydroxy $C_{12}$ to $C_{24}$ fatty acids or the esters thereof are employed.

The lithium complex soaps are prepared by employing both the $C_{12}$–$C_{24}$ fatty acid, hydroxy fatty acid or esters thereof and a $C_2$–$C_{12}$ dicarboxylic acid complexing agent. Suitable acids, therefore, include the hydroxy stearic acids, e.g., 9-hydroxy, 10-hydroxy or 12-hydroxy stearic acid. Unsaturated fatty or hydroxy fatty acids or esters thereof such as ricinolic acid which is an unsaturated form of 12-hydroxy stearic and having a double bond in the 9–10 position, as well as the ester of each acid, can also be used. The $C_2$–$C_{12}$ dicarboxylic acids employed will be one or more straight or branched chain $C_2$–$C_{12}$ dicarboxylic acids, preferably $C_4$–$C_{12}$, more preferably $C_6$ to $C_{10}$ dicarboxylic acids or the mono- or di-esters thereof Suitable examples include oxalic, malonic, succinic, glutaric, adipic, suberic, pimelic, azelaic, dodecanedioic and sebacic acids and the mono- or di-esters thereof. Adipic, sebacic, azelaic acids and mixtures thereof, preferably sebacic and azelaic acids and mixture thereof are employed as the dicarboxylic acids used in the production of the complex lithium soap grease bases.

The calcium complex soaps are prepared by employing the $C_{12}$ to $C_{24}$ fatty acid, hydroxy fatty or ester or glyceride thereof and a $C_2$ to $C_6$ short chain carboxylic acid complexing agent. Suitable acids include stearic acids, e.g., 9-hydroxy, 10-hydroxy or 12-hydroxy stearic acid. The short chain carboxylic acid can be straight chain or branched, preferably $C_2$ to $C_6$, and more preferably $C_2$, $C_3$ or $C_4$. Examples of short chain carboxylic acids include acetic acid, propanoic acid, butanoic acid, etc. Acetic acid is the preferred complexing acid in the production of calcium complex greases. Acetic acid can be added to the grease formulation in the form of the free acid and then neutralized with CaOH along with the fatty acid, fatty acid ester or fatty acid glyceride; or alternatively, calcium acetate can be added to the grease directly.

Neutralization of the simple acid type soap (simple soap) or different acid-type acid mixture (complex soap) with the base is usually conducted at a temperature in the range of about 180 to 220° F. When the soap has thickened to a heavy consistency the temperature is raised to about 290–3 10° F. to ensure elimination of water. Subsequent heating to a high temperature followed by addition of the remaining PAO or mixture of PAO's or mixure of the remaining PAO or mixture of PAO with a minor amount of white oil and/or alkyl aromatic synthetic fluid and cooling can be practiced to produce a mixed base oil containing the desired ratio of base oil components and having the target final product base oil viscosity and grease consistency.

While it is expected that the skilled practitioner of grease production will be familiar with the technique used to produce complex lithium or calcium greases, various of such production methods are presented in detail in U.S. Pat. No. 3,681,242, U.S. Pat. No. 3,791,973, U.S. Pat. No. 3,929,651, U.S. Pat. No. 5,236,607, U.S. Pat. No. 4,582,619, U.S. Pat. No. 4,435,299, U.S. Pat. No. 4,787,992. Mixed lithium-calcium soap thickened greases are described in U.S. Pat. No. 5,236,607, U.S. Pat. No. 5,472,626. The particular techniques used to produce the simple or complex lithium or calcium soaps or lithium-calcium soaps are not believed to be critical in the present invention and do not form part of the present invention. The above is offered solely as illustration and not limitation.

In the present invention the preferred thickener, regardless of the technique used for its production, is complex lithium soap.

Another complex lithium grease base is disclosed and cleared in U.S. Pat. No. 3,929,651 which also teaches a detailed procedure for its production. The teachings of that patent are incorporated herein by reference. Broadly that complex lithium grease base comprises a major amount of a base oil, a minor amount of a complex lithium soap thickener and a minor quantity of a lithium salt of a $C_3$–$C_{14}$ hydroxy carboxylic acid where in the OH group is attached to a carbon atom that is not more than 6 carbon atoms removed from the carbon of the carboxyl group.

In the system of U.S. Pat. No. 3,929,651, the complex lithium soap is any of the conventional complex lithium soaps of the literature and typically comprises a combination of a dilithium salt of a $C_2$–$C_{12}$ dicarboxylic acid or the mono- or di-ester of such acids and a lithium salt of a $C_{12}$–$C_{24}$ fatty acid or of a 9-, 10- or 12-hydroxy $C_{12}$–$C_{24}$ fatty acid or the ester of such acid. These materials have been discussed in detail above. In addition, the grease also contains an additional lithium salt component, the lithium salt of a hydroxy carboxylic acid(s) or ester(s) thereof having an OH group attached to a carbon atom that is not more than 6 carbons removed from the carbon of the carboxyl group. This acid has from 3 to 14 carbon atoms and can be either an aliphatic acid such as lactic acid, 6-hydroxydecanoic acid, 3-hydroxybutanoic acid, 4-hydroxybutanoic acid, 6-hydroxy-alpha-hydroxy-stearic acid, etc., or an aromatic acid such as para-hydroxy-benzoic acid, salicylic acid, 2-hydroxy-4 hexylbenzoic acid, meta-hydroxybenzoic acid, 2,5-dihydroxybenzoic acid (gentisic acid); 2,6-dihydroxybenzoic acid (gamma resorcyclic acid); 2-hydroxy-4-methoxybenzoic acid, etc., or a hydroxyaromatic aliphatic acid such as 2-(ortho hydroxphenyl)-, 2-(meta hydroxyphenyl)-, or 2-(parahydroxyphenyl)-ethanoic acid. A cycloaliphatic hydroxy acid such as hydroxycyclopentyl carboxylic acid or hydroxynaphthenic acid could also be used. Particularly useful hydroxy acids (or the esters thereof) are 2-hydroxy-4-methoxybenzoic acid, salicylic acid, and parahydroxybenzoic acid. Instead of using the free hydroxy acid of the latter type when preparing the grease, one can use a lower alcohol ester, e.g., the methyl, ethyl, or propyl, isopropyl, or secbutyl ester of the acid, e.g., methyl salicylate. The ester of the hydroxy carboxylic acid is hydrolyzed with aqueous lithium hydroxide to give the lithium salt. The monolithium salt or the dilithium salt of the $C_3$–$C_{14}$ hydroxy acid or ester thereof can be used, but the dilithium salt is preferred.

As taught in U.S. Pat. No. 3,929,651, these three component lithium salt thickeners can be formed in a number of different ways. One convenient way when the $C_3$–$C_{14}$ hydroxy carboxylic acid is salicylic acid is to co-neutralize the $C_{12}$–$C_{24}$ fatty acid or 9-, 10-, or 12-hydroxy $C_{12}$–$C_{24}$ fatty acid and the dicarboxylic acid in at least a portion of the oil with lithium hydroxide. In the present invention this first portion of oil is a mixture of white oil and alkyl aromatic synthetic oil or mixtures of white oil, alkyl aromatic synthetic oil and PAO base oils having a viscosity lower than that of the total oil component of the finished grease product. This neutralization will take place at a temperature in the range of about 180° F. to 220° F. When the soap stock has thickened to a heavy consistency, the temperature is raised to about 260° F. to 300° F., to bring about dehydration. The soap stock is then cooled to about 190° F. to 210° F., and the additional acid or ester of the $C_3$–$C_{14}$ hydroxy carboxylic acid, e.g., methyl salicylate is added; then, additional lithium hydroxide is added gradually to convert the acid or ester, e.g., salicylate, to the dilithium acid or ester, e.g., salicylate, salt. Reaction is conducted at about 220° F. to 240° F., preferably with agitation so as to facilitate the reaction. In this reaction, the alcohol is evolved, and dilithium acid or ester, e.g., salicylate, salt forms.

Dehydration is then completed at 300° F. to 320° F., after which the grease is heated at 380–390° F. for 15 minutes to improve its yield and is then cooled while additional oil is added to obtain the desired consistency. In the present invention this additional oil is a quantity of the remaining PAO or mixture of PAO's, or mixture of the remaining PAO or mixture of PAO's and white oil and/or alkyl aromatic synthetic base oil, the amount of such material added being (1) sufficient to raise the viscosity of the total oil component to the level desired in the finished grease and (2) sufficient to soften the base grease concentrate to the desired consistency of the finished grease. The consistency of the finished grease is measured by the ASTM D217 cone penetration test or other suitable methods and identification of the particular target consistency is left to the practitioner formulating the specific grease of interest to him or her. Alternatively, the additional oil can be added to the soap concentrate prior to the in situ formation of the dilithium acid or ester, e.g., salicylate, salt.

An alternative method is to co-neutralize all three types of acid used in making the grease, or to saponify a lower ester of the hydroxy $C_3$–$C_{14}$ acid, e.g., methyl salicylate, simultaneously with the neutralization of the hydroxy fatty acid of the first type, e.g., hydroxystearic acid and the dicarboxylic acid. Still another alternative is to co-neutralize the hydroxy fatty acid and the ester of the hydroxy $C_3$–$C_{14}$ acid followed by neutralization of the dicarboxylic acid.

The greases using this three salt component thickener system contain, based on the finished grease mass, from about 2 to about 35 wt % and preferably about 10 to about 25 wt % of all three lithium salt components. The additional lithium salt of the $C_3$–$C_{14}$ hydroxycarboxylic acid (e.g., dilithium salicylate) is present in the grease in an amount in the range 0.05 to 10 wt % of the finished grease. The proportion of the lithium soap of $C_{12}$–$C_{24}$ fatty acid or 9-, 10- or 12-hydroxy $C_{12}$–$C_{24}$ fatty acid to the lithium soap of the dicarboxylic acid can be in the range of 0.5 to 15 parts by weight of the former to one part by weight of the latter, preferably in the range of 1.5 to 5 parts by weight of the soap of the $C_{12}$–$C_{24}$ fatty acid or 9-,10- or 12-hydroxy $C_{12}$–$C_{24}$ fatty acid to one part by weight of the soap of the dicarboxylic acid. The proportion of the $C_3$–$C_{14}$ hydroxy carboxylic acid to the dicarboxylic acid will be from about 0.025 to 2.5 parts by weight of the hydroxy carboxylic acid to one part by weight of the dicarboxylic acid, preferably about 0.125 to 1.25 parts by weight of the hydroxy carboxylic acid to one part by weight of the dicarboxylic acid.

While the actual thickener yield of a particular grease is dependent on the particular kettle or vessel used to manufacture the grease and the optimum conditions of operation for that particular kettle (i.e., dehydration rate and time, water content and top temperature hold time), the present invention functions independently of such optimization of the individual and unique set of operating conditions for any particular kettle. The present invention will result in better thickener yields, relative to the case in which the base oil contains PAO and alkyl aromatic oil but does not also contain white oil. Thus, under conditions where all other process steps, equipment or variables are equal or held constant, the method of the present invention will result in unexpectedly improved thickener utilization/grease yields (i.e., grease meeting viscosity and grease consisting targets but at a lower thickener content).

Another lithium complex grease is disclosed and claimed in U.S. Pat. No. 5,731,274 which teaches that greases containing the three component lithium salt thickener system of U.S. Pat. No. 3,929,651 can have their lubricating life extended and then high temperature anti oxidancy enhanced by the addition of a thiadiazole to the grease.

The thiadiazole type materials used in those formulations are of the general formula:

$$R_1—(S)_x—Q—(S)_y—R_2$$

wherein Q is a 1,3,4-thiadiazole, 1,2,4-thiadiazole, 1,2,3-thiadiazole or a 1,2,5-thiadiazole heterocycle, "x" and "y" may be the same or different and are integers from 1 to 5 and $R_1$ and $R_2$ are the same or different and are H or $C_1$–$C_{50}$ hydrocarbyl, or $$R_1—(S)_x—Q—(S)_z—Q_2—(S)_y—R_2$$

wherein $Q_1$ and $Q_2$ are the same or different and are 1,3,4-thiadiazole, 1,2,4-thiadiazole, 1,2,3-thiadiazole or 1,2,5-thiadiazole heterocycles, "x", "y", and "z" may be the same or different and are integers of from 1 to 5, and $R_1$ and $R_2$ are the same or different and are H or $C_1$–$C_{50}$ hydrocarbyl. The preferred thiadiazole has the structure 2 where x=1, y=1 and z=2, $R_1$ =hydrogen, $R_2$ =hydrogen and $Q_1$=$Q_2$ and is 1,3,4-thiadiazole. The preferred thiadiazole is available from R. T. Vanderbilt Company, Inc., under the trade name Vanlube 829. Such thiadiazole additives can be present in the three component lithium soap/salt greases described above in an amount in the range 0.05 to 5.0 wt % based on the finished grease.

In copending application, U.S. Ser. No. 815,018, filed Mar. 14, 1997, in the name of David L. Andrew and Brian L. Slack, it is disclosed that simple and complex greases can have their corrosion resistance capacity increased by addition of 0.01 to 10 wt %, preferably 0.05 to 5 wt %, more preferably 0.2 to 1.5 wt % of a hydrocarbyl diamine of the formula:

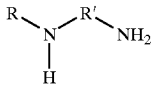

where R and R' are the same or different and are $C_1$–$C_{30}$ straight a branch chain alkyl, alkenyl, alkynyl, aryl substituted aliphatic chains, the aliphatic chains being attached to the nitrogen in the molecule. Preferably R is a $C_{12}$–$C_{18}$ hydrocarbyl moiety, preferably alkyl or alkenyl moiety, and $R_1$ is a $C_2$–$C_6$ hydrocarbyl, preferably alkyl moiety. Preferred hydrocarbyl diamines include those wherein R is a dodecylradical and R' is a 1,3 propyl diradical (commercially available from Akzo Chemie under the trade name DUOMEEN C); or wherein R=oleyl radical, R'=1, 3 propyl diradical (known as DUOMEEN O) or wherein R=tallow radicals, R'=1,3 propyl diradical (known as DUOMEEN T).

Further the grease of the present invention can contain any of the typical grease additives including conventional antioxidants, extreme pressure agents, anti wear additives tackiness agents, dyes, anti rust additives, etc. Such typical additives and their functions are described in "Modern Lubricating Greases" by C. J. Boner, Scientific Publication (G.B.) Ltd., 1976.

Examples of antioxidants include the phenolic and aminic type antioxidants and mixture thereof.

The amine type anti-oxidants include diarylamines and thiodiaryl amines. Suitable diarylamines include diphenyl amine; phenyl-α-naphthylamine; phenyl-β-naphthylamine; α-α-di-naphthylamine; β-β-dinaphthylamine; or α,β-dinaphthylamine. Also suitable antioxidants are diarylamines wherein one or both of the aryl groups are alkylated, e.g., with linear or branched alkyl groups containing 1 to 12 carbon atoms, such as the diethyl diphenylamines; dioctyldiphenyl amines, methyl phenyl-α-naphthylamines; phenyl-β (butylnaphthyl) amine; di(4-methyl phenyl) amine or phenyl (3-propyl phenyl) amine octyl-butyldiphenylamine, dioctyldiphenyl amine, octyl-, nonyldiphenyl amine, dinonyl di phenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α (methyl naphthyl) amine; thio-di (ethyl phenyl) amine; (butyl phenyl) thio phenyl amine.

Other suitable antioxidants include 2-triazines of the formula

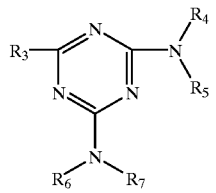

where $R_4$, $R_5$, $R_6$, $R_7$, are hydrogen, $C_1$ to $C_{20}$ hydrocarbyl or pyridyl, and $R_3$ is $C_1$ to $C_8$ hydrocarbyl, $C_1$ to $C_{20}$ hydrocarbylamine, pyridyl or pyridylamine. If desired mixtures of antioxidants may be present in the lubricant composition of the invention.

Phenolic type anti-oxidants include 2,6-di-t-butyl phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl-4-methoxyphenol; materials of the formula

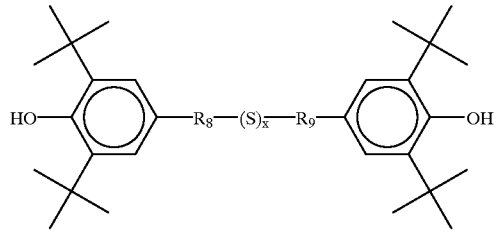

where x is zero to 5, $R_8$ and $R_9$ are the same or different and are $C_1$–$C_{20}$ hydrocarbyl which may contain oxygen or sulfur or be substituted with oxygen or sulfur containing groups; and materials of the formula

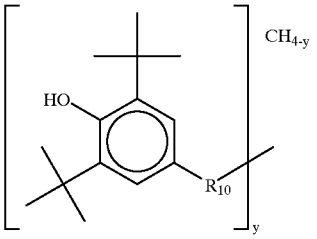

where y is 1 to 4 and $R_{10}$ is a $C_1$ to $C_{20}$ hydrocarbyl which may contain oxygen or sulfur or be substituted with oxygen or sulfur containing groups, and mixtures of such phenolic type antioxidants.

If present at all the antioxidants, preferably amine type and/or phenolic antioxidants are present in the grease in an amount up to 5 wt % of the finished grease.

Among the preferred extreme pressure and antiwear additives are lead naphthenate, lead dialkyldithiocarbamate, zinc dialkyldithiocarbamates, zinc dialkyldithiophosphates, sulfurized alkenes (e.g., sulfurized isobutylene), antimony dialkyldithiophosphates, 4,4'-methylene bis (dialkyldithiocarbamate), sulfurized fats or fatty acids, amine phosphate salts, phosphites and phosphite esters, etc.

Among the preferred anti-rust additives are various sulphonates based on sodium, barium, calcium, etc. Amine phosphates, sodium nitrite, alkylated ammonium nitrite salts, compounds containing imidazoline functionality, or zinc naphthenate can also be used as rust inhibitors.

To this additive package may be added other additives required for the specific end use, such as seal swell agents, tackiness additives, dyes, etc.

The present invention is demonstrated in the following not limiting examples and comparative examples.

Experimental

COMPARATIVE EXAMPLE 1

A lithium complex grease containing a PAO base oil with viscosity of 460 cSt at 40° C. was formed in a laboratory mixer in the following manner: A mixture of 12-hyroxystearic acid (200 g), PAO 8 (310 g), and PAO 100 (320 g) was heated to 105° C. to melt the acid. The hydroxystearic acid was then neutralized with a lithium hydroxide slurry (28.9 g of $LiOH.H_2O$ in 200 ml of water), after which the grease was heated to 150° C. to dehydrate the lithium hydroxystearate soap. The blend was then cooled to 110° C., 40 g of azelaic acid was added to the mixer, and. the temperature was adjusted to 100° C. This azelaic acid was neutralized by addition of a slurry of lithium hydroxide (18.5 g in 150 g of water). The temperature of the batch was then raised to 200° C. and held for 5 minutes, at which point PAO 100 (555 g), PAO 8 (88 g) were added (following the technique of U.S. Pat. No. 5,783,531). After milling and subsequent addition of Additive Package A (containing antiwear, extreme pressure, and antioxidant components), a grease with a worked penetration of 303 mm/10 and a 12-hydroxystearic acid content of 12.1 wt % was obtained.

COMPARATIVE EXAMPLE 2

A lithium complex base grease was produced following the method described in Example 1. In this example, the initial charge to the kettle contained 12-hydroxystearic acid (250 g), PAO 8 (220 g), PAO 100 (300 g), and an alkylbenzene synthetic base oil (180 g of Condea Vista 8560 LH). This product was neutralized with lithium hydroxide slurry (36 g of $LiOH.H_2O$ in 150 g of water), heated to 150° C. to complete the first-stage soap formation, and then cooled to 110° C. Azelaic acid (50 g) was added as per the previous example, and the grease was then neutralized (23 g of $LiOH-H_2O$ in 150 g of water), cooked to 196° C., milled and finished with PAO 8 (73.7 g), PAO 100 (968 g), 8560 LH (95 g). The base grease formed had a worked penetration of 271 mm/10 and a 12-hydroxystearate content of 11.4 wt %.

COMPARATIVE EXAMPLE 3

A grease made by blending Additive Package A into the base grease of Comparative Example 2 exhibited a worked penetration of 305 mm/10 and a 12-hydroxystearate content of 10.8 wt %.

Comparison of the greases formed in Comparative Example 1 and Comparative Example 3 demonstrates that the inclusion of the alkylbenzene synthetic fluid in the formulation leads to a yield improvement, with grease of Comparative Example 3 requiring a lower soap content than that of Comparative Example 1 to produce a product of the same worked penetration (as would be expected from the teaching of FR 2,572,089).

COMPARATIVE EXAMPLE 4

A grease was made by blending Additive Package B into base grease of Comparative Example 2 (1000 g), and a worked penetration of 279 mm/10 was obtained. Further addition of PAO 8 (8 g), PAO 100 (35 g) and 8560 LH (7.5 g) produced a grease with a worked penetration of 293 mm/10, and a 12-hydroxystearate content of 10.4 wt %.

Comparative Example 4 demonstrates that Additive Package B provides a better grease yield than Additive Package A.

Additive Package A (based upon the total grease composition) is 1.5% S/P multifunctional industrial gear package and 1.9% amine antioxidant, and 0.4% glycerin.

Additive Package B (based upon total grease composition) is 1.7% ZnDDP, 0.25% SbDDP, 1.5% amine antioxidant, 0.5% ethoxylated amine, and 0.4% glycerin.

COMPARATIVE EXAMPLE 5

A lithium complex base grease was manufactured following the method described in Comparative Example 1. In this example, the initial charge to the kettle contained 12-hydroxystearic acid (160 g) and 750 SUS naphthenic base oil (524 g). This product was neutralized with lithium hydroxide slurry (22.5 g of $LiOH.H_2O$ in 100 g of water), heated to 160° C. to complete the first-stage soap formation, and then cooled to 110° C. Azelaic acid (30.4 g) was added, and the grease was then neutralized (14.8 g of $LiOH—H_2O$ in 60 g of water), cooked to 200° C., milled and finished with PAO 8 (178 g) and PAO 100 (490 g). After milling, the base grease formed had a worked penetration of 237 mm/10 and a 12-hydroxystearate content of 11.2 wt %.

COMPARATIVE EXAMPLE 6

An aliquot of base grease prepared in Comparative Example 5 was mixed with Additive Package B and a 70:30 w/w blend of PAO 100/PAO 8 to prepare a finished grease with a worked penetration of 296 mm/10 and a 12-hydroxystearate content of 9.7 wt %.

COMPARATIVE EXAMPLE 7

A lithium complex base grease was manufactured following the method described in Comparative Example 1. In this example, the initial charge to the kettle contained 12-hydroxystearic acid (225 g) and 600N paraffinic base oil (700 g). This product was neutralized with lithium hydroxide slurry (32 g of $LiOH.H_2O$ in 140 g of water), heated to 150° C. to complete the first-stage soap formation, and then cooled to 110° C. Azelaic acid (43.2 g) was added, and the grease was then neutralized (20.48 g of $LiOH—H_2O$ in 110 g of water), cooked to 200° C., oiled back with 600N (91 g) and PAO 100 (928 g). After milling, the base grease formed had a worked penetration of 263 mm/10 and a 12-hydroxystearate content of 11.0 wt %.

COMPARATIVE EXAMPLE 8

An aliquot of base grease prepared in Comparative Example 7 was mixed with Additive Package B and a 55:45 w/w blend of 600N/PAO 100 to prepare a finished grease with a worked penetration of 301 mm/10 and a 12-hydroxystearate content of 9.2 wt %.

COMPARATIVE EXAMPLE 9

A lithium complex base grease was manufactured following the method described in Comparative Example 1. In this example, the initial charge to the kettle contained 12-hydroxystearic acid (200 g), 350 SUS white oil (500 g), and PAO 100 (200 g). This product was neutralized with lithium hydroxide slurry (28 g of $LiOH.H_2O$ in 120 g of water), heated to 150° C. to complete the first-stage soap formation, and then cooled to 110° C. Azelaic acid (38 g) was added, and the grease was then neutralized (18.5 g of $LiOH—H_2O$ in 80 g of water), cooked to 200° C., and oiled back with PAO 100 (650 g). The base grease was then milled, exhibiting a worked penetration of 304 mm/10 and a 12-hydroxystearate content of 12.1 wt %.

COMPARATIVE EXAMPLE 10

An aliquot of base grease prepared in Comparative Example 9 was mixed with Additive Package B to prepare a finished grease with a worked penetration of 330 mm/10 and a 12-hydroxystearate content of 11.6 wt %.

Comparative Examples 6, 8 and 10 illustrate that while significantly improved grease yield (i.e., lower 12-hydroxystearate wt % at comparable penetration), is obtained by use of part-synthetic blends of PAO with paraffinic or naphthenic base oils, a comparable benefit is not found for blends of PAO with white oil.

ILLUSTRATIVE EXAMPLE 1

A lithium complex base grease was manufactured following the method described in Comparative Example 1. In this example, the initial charge to the kettle contained 12-hydroxystearic acid (225 g), 350 SUS white oil (325 g), PAO 100 (225 g), and 8560 LH alkylbenzene (150 g). This product was neutralized with lithium hydroxide slurry (32 g of $LiOH.H_2O$ in 150 g of water), heated to 150° C. to complete the first-stage soap formation, and then cooled to 110° C. Azelaic acid (43.3 g) was added, and the grease was then neutralized (20.4 g of $LiOH—H_2O$ in 90 g of water), cooked to 200° C., and oiled back with PAO 100 (961 g), white oil (140 g) and 8560 LH alkylbenzene (60 g). The base grease was then milled and treated with Additive Package B. The final grease exhibited a worked penetration of 291 mm/10 and a 12-hydroxystearate content of 9.9 wt %.

Comparative Examples 1, 4 and Illustrative Example 1 show that an improved lithium complex grease yield may be obtained when white oil/alkylbenzene are used in conjunction with PAO versus what was achieved with alkylbenzene/PAO. This is unexpected, given that white oil/PAO provides no yield improvement over 100% PAO formulations.

EXAMPLE A

The greases made in Comparative Examples 4 and Illustrative Example 1 were thermally treated in an oven at 150° C. for 120 hours. At the end of the exposure, both greases showed a minor amount of softening, with worked penetrations increasing by only 10–11 mm/10. Both samples showed good color retention, darkening only slightly after high temperature exposure.

EXAMPLE B

The greases made in Comparative Examples 6, 8, and 10 were thermally treated in an oven at 150° C. for 130 hours. At the end of the test, it was found that the grease containing the napththenic oil (Comparative Example 6) showed changed penetration, hardening by 15 mm/10, and had darkened significantly. The grease containing the paraffinic oil (Comparative Example 8) had also changed penetration, softening by 30 points, and also darkened. The penetration of the white oil containing grease (Comparative Example 10) showed stable penetration (only 5 mm/10 softening) and exhibited good color stability.

Comparative Example A and B show that grease made with alkylbenzene/white oil/PAO (Illustrative Example 1) exhibits thermal stability superior to that obtained by blends containing conventional mineral oil and PAO, and comparable to that obtained with alkylbenzene/PAO or white oil/PAO.

ILLUSTRATIVE EXAMPLE 2

A lithium complex grease was manufactured following the procedure outlined in Mustrative Example 1. The final grease contained 11% 12-hydroxystearic acid, 2.1% azelaic acid, 2.5% lithium hydroxide monohydrate, 10.5% 8560 LH alkylbenzene, 19.8% 350 SUS USP white oil, 48.8% PAO 100, and an additive package comprised of 1.0% of an ashless dithiocarbamate, 1.7% zinc dialkyldithiophosphate, 1.5% alkylated diphenylamine, 0.75% zinc naphthenate, and 0.35% glycerin. The final grease had a worked penetration of 298 mm/10 and exhibited excellent color stability after six days at 130° C.

What is claimed is:

1. A lubricating grease composition comprising a major portion of a base oil of lubricating viscosity and a minor portion of a thickener, wherein the base oil of lubricating viscosity comprises a mixture of about 10 to 40 wt % white oil, about 5 to 30 wt % of one or more alkyl aromatic synthetic oils and greater than about 40 wt % of one or more poly alpha olefin(s).

2. The lubricating grease composition of claim 1 wherein the thickener is simple or complex lithium soap, simple or complex calcium soap, mixed lithium and calcium simple or complex soaps, aluminum soaps, urea, di-urea, tri-urea or poly-urea.

3. The lubricating grease composition of claim 1 or 2 wherein the base oil of lubricating viscosity comprises about 10 to 20 wt % alkyl aromatic synthetic oil.

4. The lubricating grease composition of claim 1 or 2 wherein the base oil of lubricating viscosity comprises about 20 to 30 wt % white oil.

5. The lubricating grease composition of claim 1 or 2 wherein the base oil of lubricating viscosity comprises greater than about 50 wt % polyalpha olefin.

6. The lubricating grease composition of claim 1 or 2 wherein the polyalpha olefin has a viscosity in the range of about 1 to 150 cSt at 100° C.

7. The lubricating grease composition of claim 1 or 2 wherein the alkyl aromatic synthetic oil is selected from the group consisting (1) one or more mono- or polyalkyl substituted benzene or naphthalene wherein the alkyl substitutent is straight or branch chain $C_3$ to $C_{30}$ hydrocarbyl group, (2) diaryl alkane and mixtures thereof.

8. A method for improving the thermal stability and improve the thickener utilization of a grease comprising a major amount of a base oil containing an alkylaromatic synthetic oil fluid and PAO and a minor amount of a thickener by including in the base oil about 10 to 40 wt % of white oil based on all the oil components present.

9. The method of claim 8 wherein the thickener is simple or complex lithium soap, simple or complex calcium soap, mixed lithium and calcium simple or complex soaps, aluminum soaps, urea, di-urea, tri-urea or poly-urea.

10. The method of claim 8 or 9 wherein the base oil of lubricating viscosity comprises about 5 to 30 wt % alkyl aromatic synthetic oil, about 10 to 40 wt % white oil and greater than about 40 wt % poly alpha olefin, all based on the oil components.

11. The method of claim 10 wherein the base oil of lubricating viscosity comprises about 10 to 20 wt % alkyl aromatic synthetic oil.

12. The method of claim 10 wherein the base oil of lubricating viscosity comprises about 20 to 30 wt % white oil.

13. The method of claim 10 wherein the base oil of lubricating viscosity comprises greater than about 50 wt % polyalpha olefin.

14. The method of claim 8 or 9 wherein the polyalpha olefin has a viscosity in the range of about 1 to 150 cSt at 100° C.

15. The method of claim 8 or 9 wherein the alkyl aromatic synthetic oil is selected from the group consisting (1) one or more mono- or polyalkyl substituted benzene or naphthalene wherein the alkyl substitutent is straight or branch chain $C_3$ to $C_{30}$ hydrocarbyl group, (2) diaryl alkane and mixtures thereof.

* * * * *